US011693359B2

(12) United States Patent
Osada

(10) Patent No.: US 11,693,359 B2
(45) Date of Patent: Jul. 4, 2023

(54) IMAGE FORMING APPARATUS HAVING A SUCTION PORT AND A BLOWING PORT ARRANGED AT DIFFERENT POSITIONS

(71) Applicant: Canon Kabushiki Kaisha, Tokyo (JP)

(72) Inventor: Takehito Osada, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/671,955

(22) Filed: Feb. 15, 2022

(65) Prior Publication Data

US 2022/0260952 A1 Aug. 18, 2022

(30) Foreign Application Priority Data

Feb. 18, 2021 (JP) ..... 2021-024574

(51) Int. Cl.
*G03G 21/20* (2006.01)
*G03G 15/20* (2006.01)
*G03G 15/00* (2006.01)

(52) U.S. Cl.
CPC ..... *G03G 21/206* (2013.01); *G03G 15/2028* (2013.01); *G03G 15/6573* (2013.01); *G03G 2215/00417* (2013.01); *G03G 2221/1645* (2013.01)

(58) Field of Classification Search
CPC ..... G03G 21/206; G03G 15/2028; G03G 15/6552; G03G 15/6573; G03G 2215/00417; G03G 2215/00421; G03G 2215/0043; G03G 2221/1645
See application file for complete search history.

(56) References Cited

U.S. PATENT DOCUMENTS

| | | | | |
|---|---|---|---|---|
| 9,811,030 | B2 | 11/2017 | Masuda | |
| 11,208,286 | B2 | 12/2021 | Morita | |
| 2012/0201564 | A1* | 8/2012 | Masuda | G03G 15/657 399/92 |
| 2019/0332053 | A1* | 10/2019 | Kawasumi | G03G 21/206 |

FOREIGN PATENT DOCUMENTS

| | | | |
|---|---|---|---|
| JP | 4886018 | B2 | 2/2012 |
| JP | 4908944 | B2 | 4/2012 |
| JP | 2012073335 | A | 4/2012 |
| JP | 5353333 | B2 | 11/2013 |
| JP | 6083999 | B2 | 2/2017 |
| JP | 2020112709 | A | 7/2020 |
| JP | 2021051255 | A | 4/2021 |

* cited by examiner

*Primary Examiner* — Arlene Heredia
*Assistant Examiner* — Laura Roth
(74) *Attorney, Agent, or Firm* — Venable LLP

(57) ABSTRACT

Provided is an image forming apparatus, including; an imaging forming unit for forming a toner image on one surface of a recording material; a fixing unit that includes a heating unit and heats and fixes the toner image formed on the one surface; a discharging unit for discharging the recording material, on which the toner image is fixed, to a discharged paper tray; and a guide member that is disposed between the fixing unit and the discharging unit and forms a recording material conveying path for conveying the recording material from the fixing unit to the discharging unit. On the guide member, a blowing port to send air to the recording material conveying path and a suction port to suck air from the recording material conveying path are disposed on a same surface so as not to cross over the recording materials.

14 Claims, 9 Drawing Sheets

IMAGE FORMING APPARATUS HAVING A SUCTION PORT AND A BLOWING PORT ARRANGED AT DIFFERENT POSITIONS

BACKGROUND OF THE INVENTION

Field of the Invention

The present invention relates to an image forming apparatus.

Description of the Related Art

In an image forming apparatus, such as a copier and a laser beam printer, an electrophotographic system, which forms toner images using an image bearing member, is known. The image forming operation of the electrophotographic type image forming apparatus is generally as follows. First an exposing unit forms an electrostatic latent image on a uniformly charged photosensitive member by performing exposure based on image information. Next a developing unit develops the electrostatic latent image to form a toner image. Next a transfer unit transfer the toner image onto a recording material. Then a fixing unit heats and presses the recording material so as to fix the toner image onto the recording material. The recording material, on which the toner image is transferred, passes through a discharged paper conveying unit which is disposed downstream from the fixing unit, is guided to a discharging unit, and is discharged to a discharge paper tray disposed outside the image forming apparatus main body.

In the above mentioned image forming operation, the temperature of the recording material is risen by heating. If the recording material is transported in the high temperature state, the toner on the recording material may not completely solidify and have viscosity in some cases. If the recording material on which toner is not completely solidified contacts a conveying guide, the toner may adhere to the conveying guide. Further, the recording materials loaded on the discharged paper tray may stick to each other. Furthermore, if the internal temperature of the image forming apparatus is increased by the high temperature recording material and the discharged paper conveying unit reaches a high temperature, components may thermally expand or deform, and as a result, the contact state between the recording material and the components may change, and a conveying failure may occur.

In order to control this temperature rise of the recording material, a method of cooling the recording material of which temperature has risen high was proposed. For example, Japanese Patent Application Publication No. 2012-073335 and Japanese Patent Application Publication No. 2020-112709 disclose a method of cooling the recording material and the discharged paper conveying unit by blowing air into the discharged paper conveying unit from the lower part, and releasing heat out of the apparatus by exhausting the air from the upper part of the discharged paper conveying unit.

SUMMARY OF THE INVENTION

In recent years, image forming apparatuses are demanded to have higher productivity and smaller sizes, hence heat generated by the fixing unit tends to increase, and the temperature of recording materials also tends to increase. However, if the recording material is conveyed in the high temperature state, the toner on the recording materials contacts the conveying guide before completely solidifying, which causes such problems as the adhesion of toner on the conveying guide, and the sticking between the recording materials that are loaded on the discharged paper tray. Further, a part of the heat generated by the heating of the recording materials remains in the vicinity of the fixing apparatus, and the heat that accumulated increases each time a toner image on a recording material is fixed. As a result, the internal temperature of the image forming apparatus increases, which may cause thermal expansion and deformation of components constituting the image forming apparatus. This may change the contact state of the components and the recording materials, and may cause a conveying failure. In the case where the spacing of recording materials, which are continuously conveyed, is narrowed by improve productivity as well, the recording materials and the discharged paper conveying unit must be cooled efficiently.

With the foregoing in view, it is an object of the present invention to increase the cooling effect to cool the recording materials and the interior of the image forming apparatus, while avoiding an increase in the size of the apparatus.

The present invention provides an image forming apparatus, comprising:

an image forming unit configured to form a toner image on one surface of a recording material;

a fixing unit that includes a heating unit and is configured to heat and fix the toner image formed on the one surface of the recording material;

a discharging unit configured to discharge the recording material, on which the toner image is fixed by the fixing unit, to a discharged paper tray; and a guide member that is disposed between the fixing unit and the discharging unit and is configured to form a recording material conveying path for conveying the recording material from the fixing unit to the discharging unit, wherein on the guide member, a blowing port to send air to the recording material conveying path and a suction port to suck air from the recording material conveying path are disposed on a same surface so as not to cross over the recording material being conveyed.

According to the present invention, the cooling effect to cool the recording materials and the interior of the image forming apparatus can be improved, while avoiding an increase in the size of the apparatus.

Further features of the present invention will become apparent from the following description of exemplary embodiments with reference to the attached drawings.

DESCRIPTION OF THE EMBODIMENTS

Examples to carry out the present invention will be described in detail with reference to the drawings and embodiments. Unless otherwise specified, the functions, materials, dimensions, shapes and relative positions of the components described in the embodiments are not intended to limit the scope of the invention. Further, in the following description, the functions, materials, dimensions, shapes and relative positions of members are the same as the initial description, unless otherwise specified.

Embodiment 1

Embodiment 1 will be described with reference to FIGS. 1 to 7. In Embodiment 1, a full color laser beam printer, including a plurality of photosensitive drums, will be described. However, the present invention is not limited to this, and is also applicable to a monochrome copier or printer which includes one photosensitive drum, for example.

Figure 7:
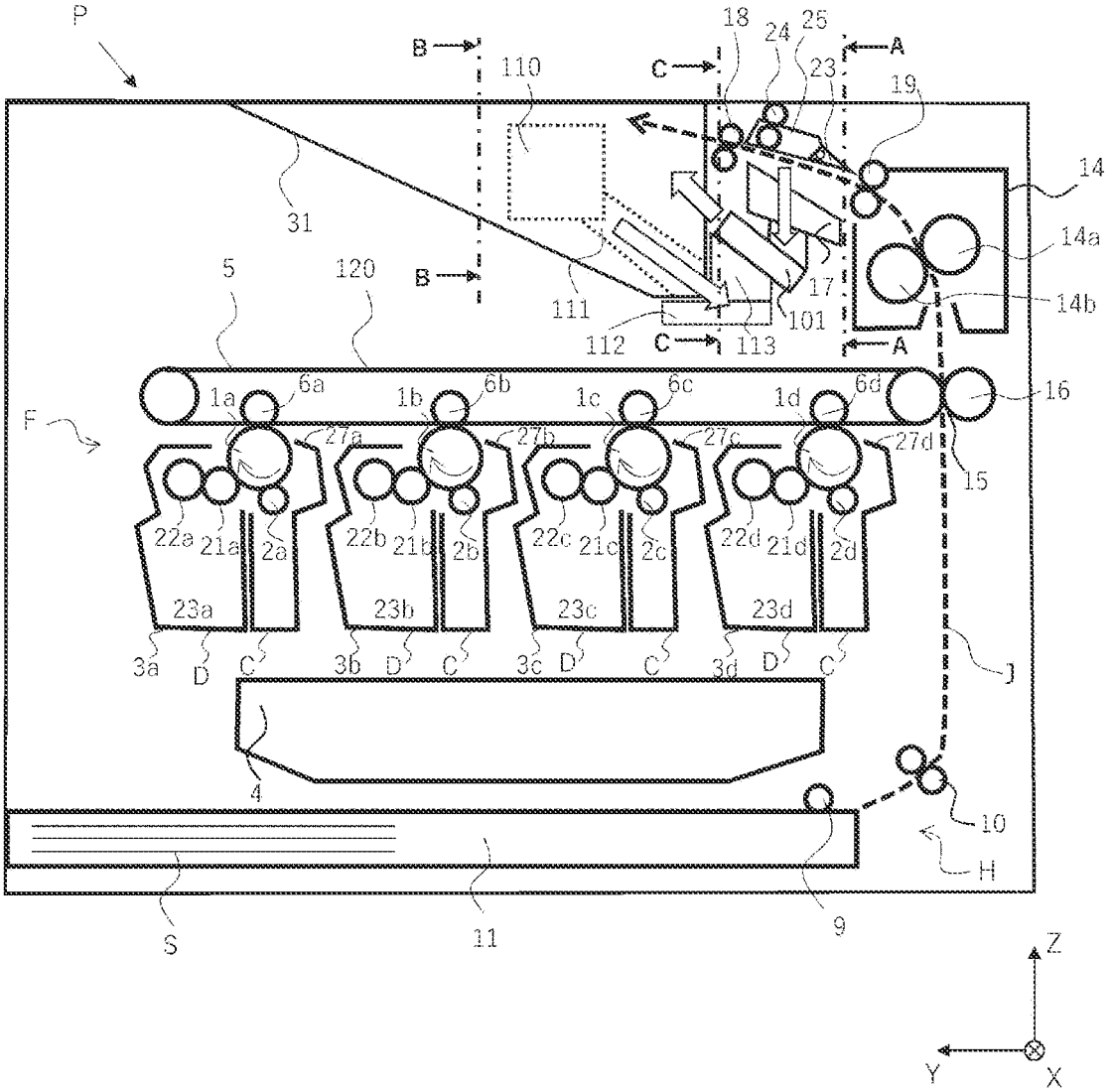
FIG. 7 is a cross-sectional view of the image forming apparatus in general according to Embodiment 1.

FIG. 7 is an overview of an image forming apparatus P of Embodiment 1. In general, the image forming apparatus P is constituted of an image forming unit F, which is an image forming unit configured to form a toner image, and a fixing apparatus 14, which is a fixing unit configured to fix a toner image onto a recording material S.

The image forming unit F includes four process cartridges 3 (3*a*, 3*b*, 3*c* and 3*d*), a laser scanner 4 (optical unit) and a transfer unit 5. Each process cartridge 3 (3*a* to 3*d*) is a cartridge in which process units that act on a photosensitive drum 1 (image bearing member) are integrated, and is designed to be detachable from the image forming apparatus P. The four process cartridges 3*a* to 3*d* have identical structures, but the colors for forming an image are different. In other words, the four process cartridges 3*a* to 3*d* use yellow (Y), magenta (M), cyan (C) and black (Bk) toner respectively. In the following description, for the configuration common to each color, each process cartridge 3*a*, 3*b*, 3*c* or 3*d* is generally referred to as a process cartridge 3, omitting the suffixes a to d. For the other composing elements as well, suffixes a, b, c and d correspond to Y, M, C and K respectively, but the suffixes may be omitted if a distinction in color is not required.

The process cartridge 3 is constituted of a developing unit D and a cleaner unit C. The developing unit includes a developing roller 21, a developer coating roller 22 and a toner container 23. The cleaner unit C, on the other hand, includes a photosensitive drum 1 (image bearing member), a charging roller (charging unit 2), and a cleaning blade (cleaning unit 27). A series of image forming steps performed by the image forming unit F is controlled by a control unit (not illustrated) which is constituted of an information processing unit, including a processor, memory, and the like. The control unit operates in accordance with input which the user performed via an operation panel, and the instructions of the program developed in the memory, and forms an image by sending and receiving information, such as instruction signals, to/from each composing element of the apparatus.

Both edges of the photosensitive drum 1 are rotatably supported by a flange, and the photosensitive drum 1 is rotary-driven in the clockwise direction (arrow direction) in FIG. 7 by transferring the drive force from a drive motor (not illustrated) to one edge. In the vicinity of the photosensitive drum 1, the charging unit 2, the developing roller 21, the transfer unit 5 and the cleaning unit 27 are disposed sequentially in the rotating direction.

The charging unit 2 is a conductive roller, and when this roller is contacted to the surface of the photosensitive drum 1 and a charging bias voltage is applied to the roller from a power supply (not illustrated), the surface of the photosensitive drum 1 is uniformly charged. The laser scanner 4 is disposed below the process cartridge 3 in the perpendicular direction, and emits a light to the photosensitive drum 1 for exposure based on image signals. Thereby an electrostatic latent image is formed on the photosensitive drum 1. For the image signals, the signals that the control unit received from outside the apparatus and stored in the memory can be used.

The toner containers 23*a* to 23*d* of the developing unit D store toner of each color: yellow (Y), magenta (M), cyan (C) and black (Bk) respectively. The developing roller 21 of the developing unit D is adjacent to the surface of the photosensitive drum 1, and is rotary-driven by a driving unit (not illustrated), and also develops the electrostatic latent image on the photosensitive drum 1 onto a toner image by applying a developing vias voltage using a developing bias power supply (not illustrated).

An intermediate transfer belt 120, included in an intermediate transfer member unit (transfer unit 5), is stretched around a driving roller and a tension roller, and tensile force is applied to the intermediate transfer belt 120 by a tension roller. Primary transfer rollers 6*a* to 6*d*, included in the intermediate transfer member unit, are disposed on the inner side of the intermediate transfer belt 120, so as to face the photosensitive drums 1*a* to 1*d* via the intermediate transfer belt 120. Transfer bias is applied to the primary transfer roller 6 by a bias applying unit (not illustrated). Toner images that are formed on the photosensitive drums 1*a* to 1*d* are primary-transferred onto the intermediate transfer belt 120 sequentially from the photosensitive drum 1*a* when positive polarity bias is applied to the primary transfer roller 6. The four colors of the toner images in the superimposed state on the intermediate transfer belt are transported to a secondary transfer unit 15.

A feeding apparatus H is constituted of a paper feeding roller 9, which feeds a recording material S from a paper feeding tray 11 storing recording materials S, and a conveying roller pair 10 which transports the fed recording material S. The user extracts the paper feeding tray 11 from the apparatus main body, sets the recording materials S, and inserts the paper feeding tray 11 back into the main body, thereby the recording materials S can be replenished. The recording materials S stored in the paper feeding tray 11 are pressed by the paper feeding roller 9, and are separated one by one by a separating pad, and conveyed on a conveying path J.

A transfer bias is applied to a secondary transfer roller 16 by a bias applying unit (not illustrated). By applying a positive polarity bias to the secondary transfer roller 16 in the secondary transfer unit 15, the four-color toner image on the intermediate transfer belt 120 is secondarily-transferred to the recording material S conveyed on the conveying path J.

The fixing apparatus 14 (fixing unit) is constituted of a heating unit 14*a* that heats the recording material S and a pressure roller (nip forming member) 14*b* that presses the recording material S to the heating unit 14*a*, such that a nip, to hold and convey the recording material, is formed. The fixing apparatus 14 also includes a fixing conveying roller pair 19 that conveys the recording material S, which passed through the nip, outside the fixing apparatus 14 (toward downstream of the conveying path J). The heating unit 14*a* heats the recording material S to which pressure was applied in the nip formed between the heating unit 14*a* and the pressure roller 14*b*. By the heat and pressure applied in the nip, the toner image transferred onto the recording material S is fixed to the recording material S. One of the two surfaces of the recording material S becomes a recording surface on which the toner image, transferred by the image forming unit F, is fixed by the fixing apparatus 14. In the case of forming images on both surfaces of the recording material S, the recording surface and the opposite surface thereof are reversed after an image is formed on one recording surface as already mentioned, then another image is formed on the opposite surface of the recording surface.

After fixing the image, the recording material S, discharged from the fixing apparatus 14 by the fixing conveying roller pair 19, passes through a section between a lower guide member 17 and an upper guide member 25 which are disposed between the fixing apparatus 14 and discharging roller pair 18 (discharging unit), and is discharged onto a discharged paper tray 31 by the discharging roller pair 18. By the above sequence of steps, image formation on the recording material S completes.

In the case of forming images on both surfaces of the recording material S, the position of a flapper 23 is switched, so that the tip of the flapper 23 comes onto the conveying path J. Thereby the recording material S that passed the fixing apparatus 14 is conveyed to a reversing roller pair 24. Then the direction of the recording material S is reversed by the reversing roller pair 24, and is conveyed again to the secondary transfer unit 15 via a double-sided path (not illustrated). Thereby an image is also formed on opposite side surface of the recording material S.

Configuration to Cool Recording Material S

A configuration to cool the recording material S and the inside of the image forming apparatus P will be described with reference to FIGS. 1 to 7. In each illustration, composing elements not required for the description may be omitted.

Figure 1:
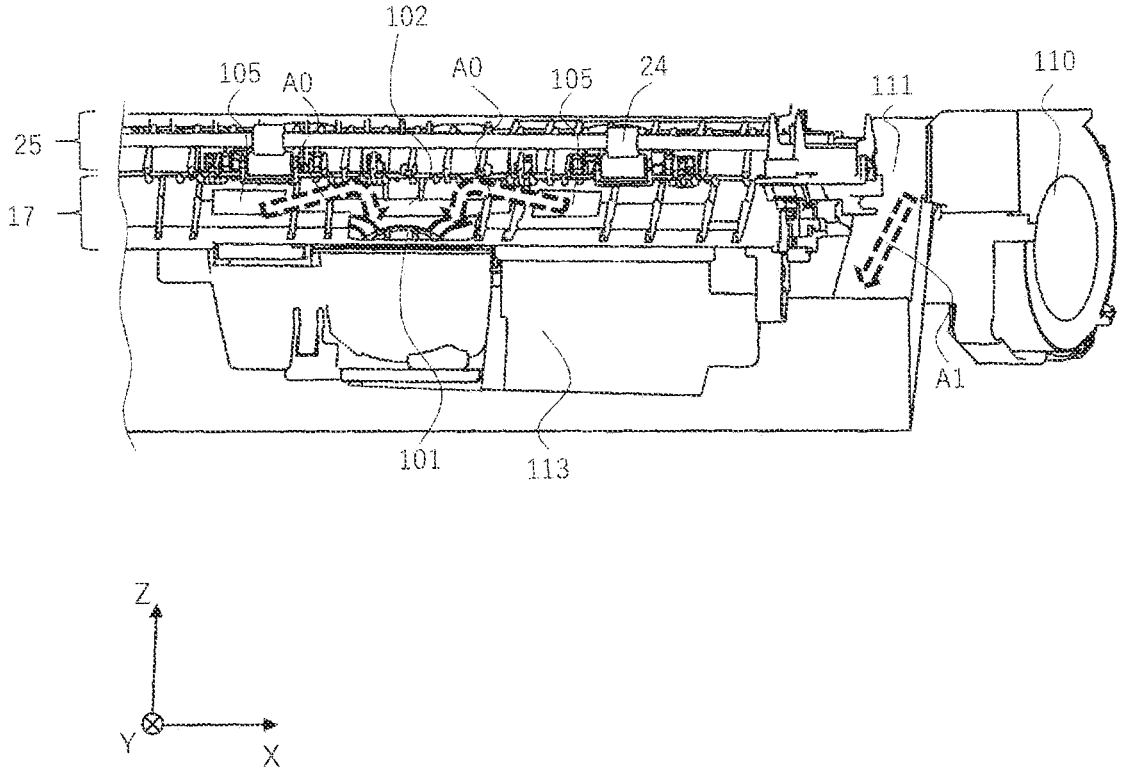
FIG. 1 is a diagram indicating a flow of air in the vicinity of a transporting mechanism of an image forming apparatus of Embodiment 1.

FIG. 1 is a view in the direction of the arrows of A-A in FIG. 7, and indicates a configuration of the lower guide member 17 disposed between the fixing apparatus 14 and the discharging roller pair 18. The upper guide member 25 and the lower guide member 17 are disposed in parallel in the Z direction, and extend in the X direction so as to guide conveying of the recording material S. In FIG. 1, the flapper 23 is omitted.

The lower guide member 17 includes blowing ports 105 to send air and a suction port 102 to suck air. Since both the blowing ports 105 and the suction port 102 are disposed on a lower guide member 17, the blowing ports 105 and the suction port 102 are disposed on the same plane, without crossing over the recording material S that is conveyed on the conveying path J. Because of this disposition, the blowing ports 105 and the suction port 102 face one surface of the recording material S that is being conveyed. As a result, air can be efficiently sent to the surface where the toner image is transferred. The suction port 102 and a suction fan 101 are disposed on the lower guide member 17 at positions facing an approximate center portion of the recording material S, in a direction orthogonal to the conveying direction of the recording material S. Here the approximate center portion of the recording material S need not be exactly in the center, but preferably is in an area where the cooling effect by suction is implemented evenly on both sides of the recording material S. The blowing ports 105 are disposed on both sides of the suction port 102 in the direction orthogonal to the conveying direction of the recording material S (X direction in FIG. 1). By the later mentioned means, air flow is generated in the A0 directions from the blowing ports 105 to the suction port 102.

Figure 2:
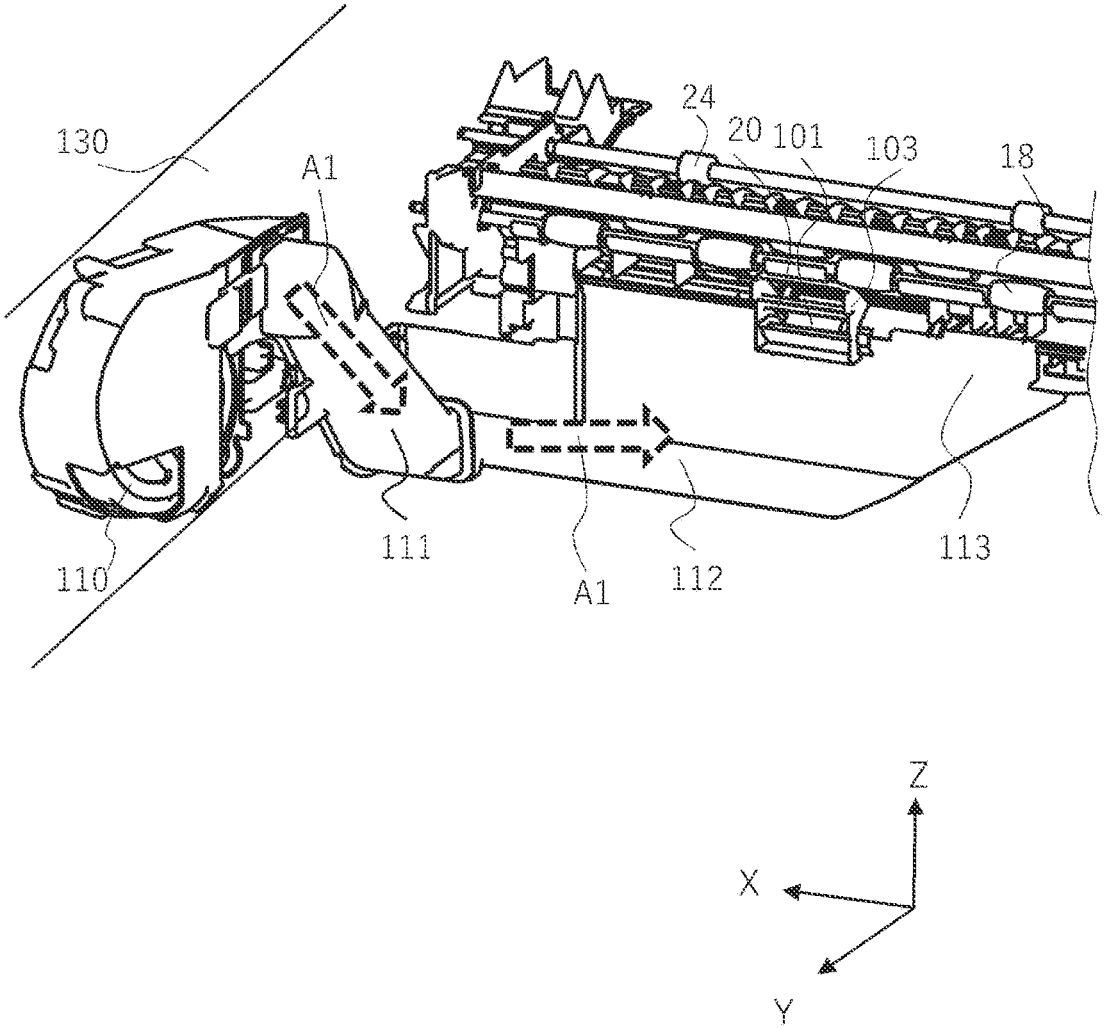
FIG. 2 is a diagram indicating the flow of air by a blowing fan according to Embodiment 1.

FIG. 2 is a view in the direction of the arrows of B-B in FIG. 7, and indicates a path to send air to the blowing ports 105. A blowing fan 110, to send air to the blowing ports, is disposed at a position close to an exterior surface 130. This is to efficiently suck in fresh air from outside the image forming apparatus. Here an upstream blowing duct 111, a downstream blowing duct 112 and a suction fan lower duct 113 are connected, as illustrated in FIG. 7. Therefore the air outside the image forming apparatus, taken inside by the blowing fan 110 sequentially flows inside the upstream blowing duct 111, the inside of the downstream blowing duct 112, and the inside of the suction fan lower duct 113 as indicated by the arrows A1. A number of blowing fans 110 and positions thereof are not limited to the illustrated example.

Figure 3:
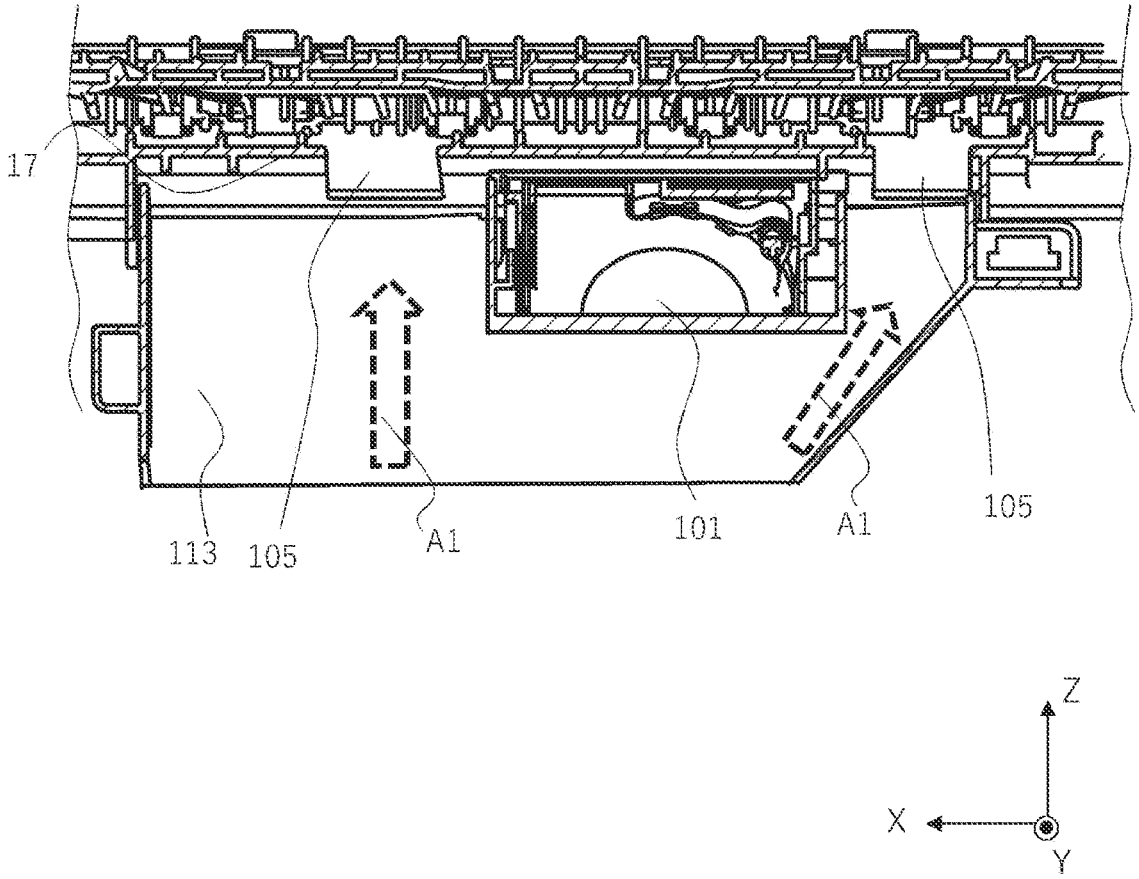
FIG. 3 is a diagram indicating the flow of air by a blowing fan according to Embodiment 1.

FIG. 3 is a view in the direction of the arrows of C-C in FIG. 7. FIG. 3 indicates the flow of air inside of the suction fan lower duct 113. The air received from the downstream blowing duct 112 is separated inside of the suction fan lower duct 113, as indicated by the arrows A1, and is released from the blowing ports 105 which are disposed on the lower guide member 17. The released air is blown into the apparatus, as indicated by the arrows A0 in FIG. 1.

Figure 4:
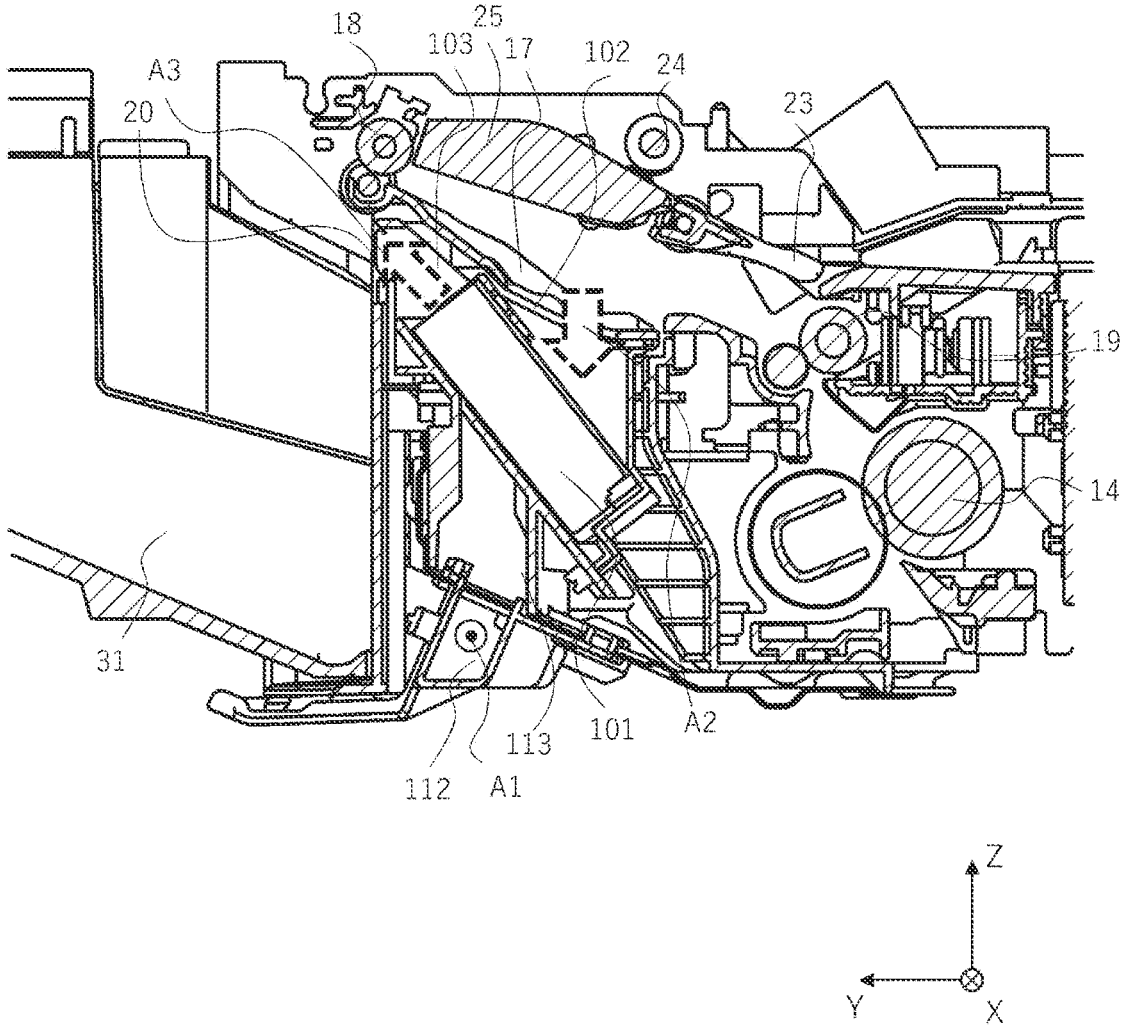
FIG. 4 is a cross-sectional view indicating the flow of air in the vicinity of the fixing unit of the image forming apparatus of Embodiment 1.

FIG. 4 is a cross-sectional view in the vicinity of the fixing apparatus 14 at an approximate center portion in the direction orthogonal to the conveying direction of the recording material S, and indicates the air flow generated by the suction fan 101. The suction fan 101 is installed on the suction fan lower duct 113, which is disposed between the discharged paper tray 31 and the fixing apparatus 14. The air on the recording material conveying path is sucked by the suction fan 101 via the suction port 102 (suction unit), so as to generate air that flows in the A2 direction.

In Embodiment 1, air, which is sent to the blowing ports 105 described in FIG. 2, flows from the rear to the front direction (indicated by A1 in FIG. 4) below the suction fan 101. In Embodiment 1, a sirocco fan is used for the suction fan 101. In the sirocco fan, suction direction and exhaust direction are orthogonal to each other. Therefore when the air inside the apparatus is sucked through the suction port 102 and is discharged outside the apparatus through an exhaust duct 103, the direction of air to be discharged does not interfere with the A1 direction, and the air in the A1 direction is not changed. The suction fan 101 exhausts air in the A3 direction through an exhaust port 20, which is disposed below the discharging roller pair 18 in the perpendicular direction, via the exhaust duct 103, so as to discharge air to outside the image forming apparatus.

According to the configuration of Embodiment 1 as described with reference to FIGS. 1 to 4, a circulation of air, including an air flow from the blowing ports 105 to the suction port 102 in the arrow A0 directions indicated in FIG. 1, is generated in the region between the fixing apparatus 14 and the discharging roller pair 18. Further, the suction port 102 is disposed at the approximate center portion in the direction orthogonal to the conveying direction, and the blowing port 105 is disposed on both sides of the suction port 102, hence the air capacity of the air in the direction orthogonal to the conveying direction can be uniform.

As a result, an increase in the temperature of the recording material S, the ambient temperature in the vicinity of the fixing conveying roller pair 19 and the internal temperature of the image forming apparatus P can be controlled. This means that problems caused by an increase in the internal temperature of the image forming apparatus P can be controlled.

In the lower guide member 17, the blowing ports 105 and the suction port 102 are disposed on a same surface without crossing over the recording material S. Therefore the air circulation between the blowing ports 105 and the suction port 102 is not interrupted, even while the recording material S is being conveyed by the fixing conveying roller pair 19 and the discharging roller pair 18. Hence even if a case where the recording materials S are continuously conveyed to improve productivity and the spacing between the recording materials S becomes narrow, the circulation paths of the air are not interrupted.

Figure 5:
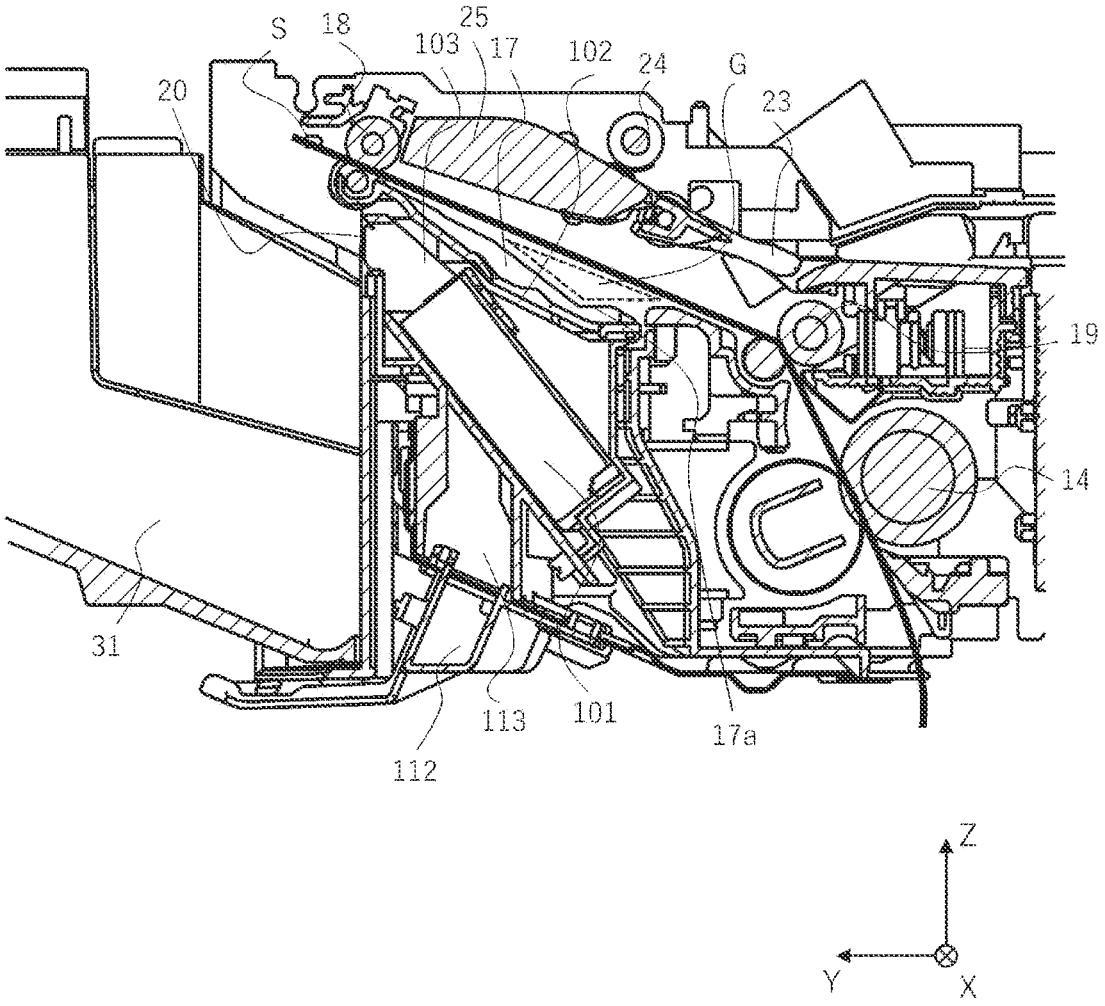
FIG. 5 is a cross-sectional view of conveying a recording material in the vicinity of the fixing unit of the image forming apparatus of Embodiment 1.

FIG. 5 is a cross-sectional view near the fixing unit when the recording material S is being conveyed by the fixing conveying roller pair 19 and the discharging roller pair 18. As illustrated, it is preferable to maintain a certain amount of gap G between the recording material S and the lower guide member 17, even during conveying the recording material S. The shapes of the members constituting the conveying path J are preferably designed considering this aspect. Thereby the interior of the apparatus can be efficiently cooled. It is also preferable that the size of the gap G is such that at least the recording material S being conveyed does not contact the lower guide member 17, and the air flow between the blowing ports 105 and the suction port 102 is ensured. The amount of air flow that is required for efficient cooling is designed in accordance with the configuration of the apparatus, the frequency of the image formation, the continuation of the image formation, and the like.

In Embodiment 1, in order to ensure the gap G, the recording material S does not contact with the lower guide member 17 while the recording material S is being pulled to the discharging roller pair 18 between the fixing conveying roller pair 19 and the discharging roller pair 18.

Figure 6:
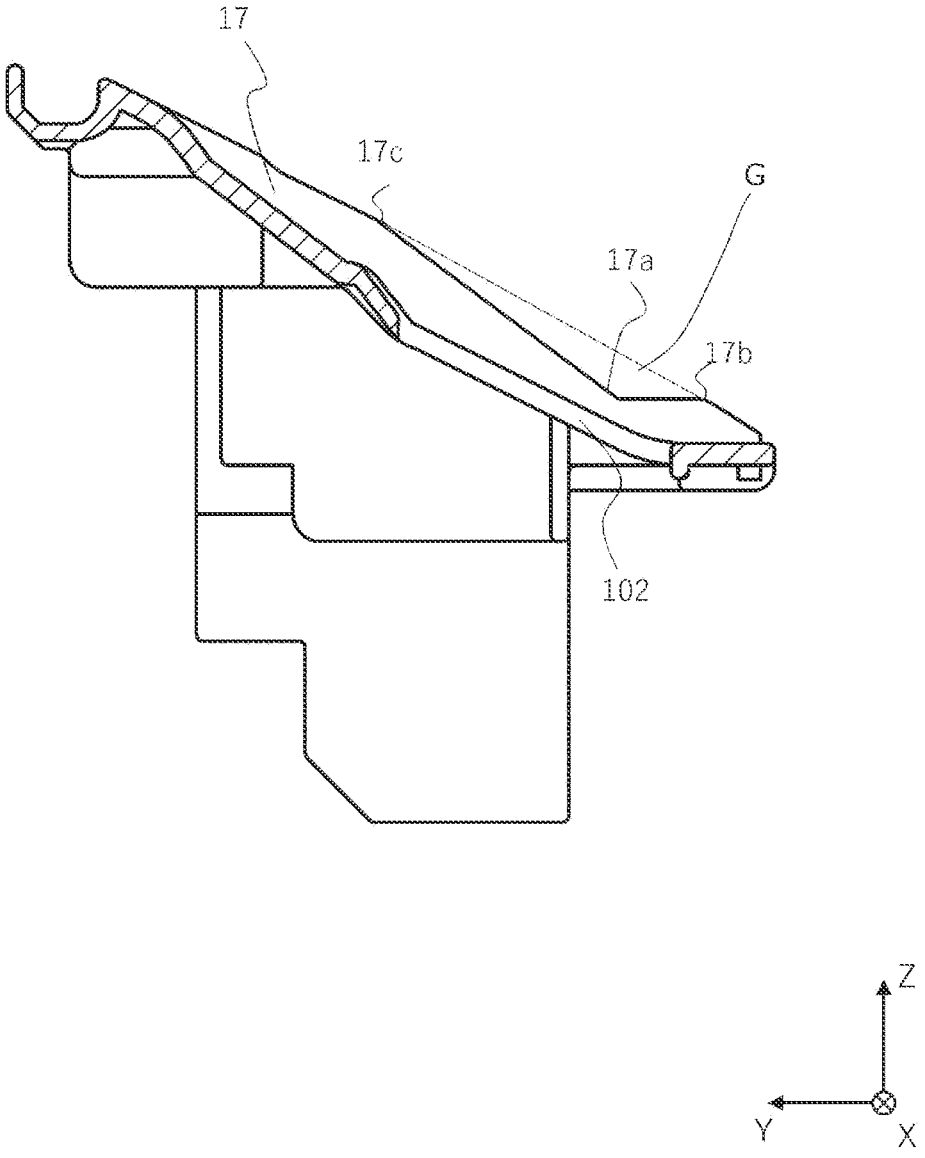
FIG. 6 is a cross-sectional view of a conveying unit guide member of the image forming apparatus of Embodiment 1.

FIG. 6 is a cross-sectional view of the lower guide member 17. In order to ensure the predetermine amount of the gap G in FIG. 5, a depressed portion 17*a* is formed in the paper passing portion of the lower guide member 17. Specifically, in the recording material conveying unit of the lower guide member 17, the depressed portion 17*a* is formed to be concave-shaped toward the suction port 102 side, with respect to the broken line connecting the paper passing portion 17*b* of the suction port 102 upstream in the conveying direction of the recording material S and the paper passing portion 17*c* of the suction port 102 downstream in the conveying direction of the recording material S. By creating this shape, the size of the gap G can be increased, and the recording material S and the inside of the apparatus can be efficiently cooled. Further, in the direction orthogonal to the conveying direction, the depressed portion 17*a* creates a space, including at least the suction port 102 and the two blowing ports 105 disposed on the left and right of the suction port 102. Thereby the gap between the recording material S and the lower guide member 17, corresponding to the region facing the blowing ports 105 and the suction port 102, becomes wider than the other regions even during conveying the recording material S, so that the air flow from the blowing ports 105 to the suction port 102 is not interrupted.

In Embodiment 1, the air flow, in the case when the recording material S is being conveyed from the fixing apparatus 14 to the discharging roller pair 18, was described, but the recording material S and the interior of the apparatus can be cooled in the same manner, even in a case where the recording material S is conveyed from the fixing apparatus 14 to the reversing roller pair 24, to form images on both sides of the recording material S.

Modification

In Embodiment 1, the suction port 102 and the blowing ports 105 are disposed on the lower guide member 17, which is disposed between the fixing apparatus 14 and the discharging roller pair 18. However, the guide member used here is not limited to the lower guide member 17, and a similar effect can be implemented even in a case where the suction port and the blowing port are disposed on the upper guide member 25 to circulate air.

Embodiment 2

Embodiment 2 of the present invention will be described next with reference to FIGS. 8 and 9. A composing element the same as Embodiment 1 is denoted with a same reference sign, and description thereof will be simplified.

Figure 8:
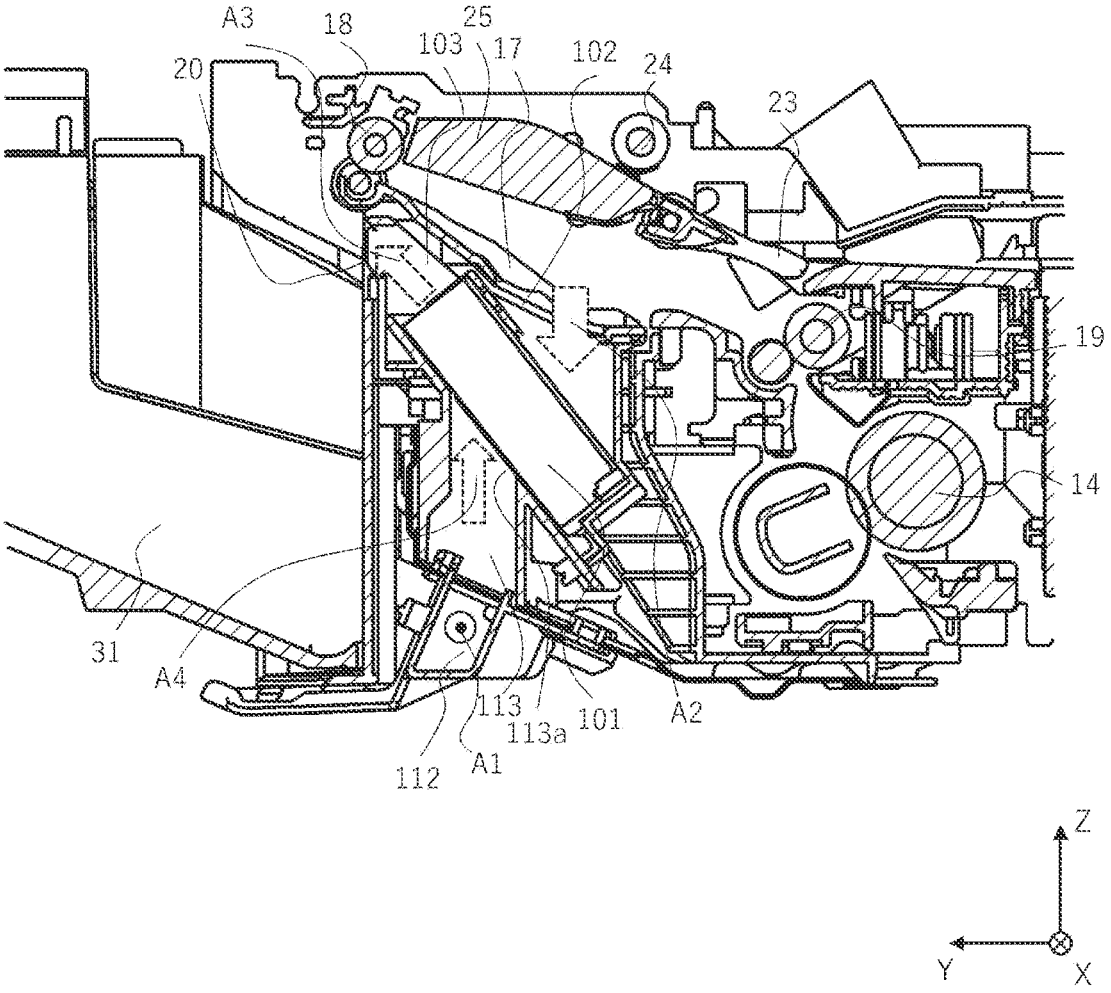
FIG. 8 is a cross-sectional view of a vicinity of a fixing unit of an image forming apparatus of Embodiment 2.

FIG. 8 is a cross-sectional view in the vicinity of the fixing apparatus 14 at an approximate center portion in the direction orthogonal to the conveying direction of the recording material S. Unlike the case of FIG. 4, a suction fan lower duct hole 113*a* is formed in the lower part of the suction fan 101 of the suction fan lower duct 113, and a part of the casing of the suction fan 101 is exposed.

Figure 9:
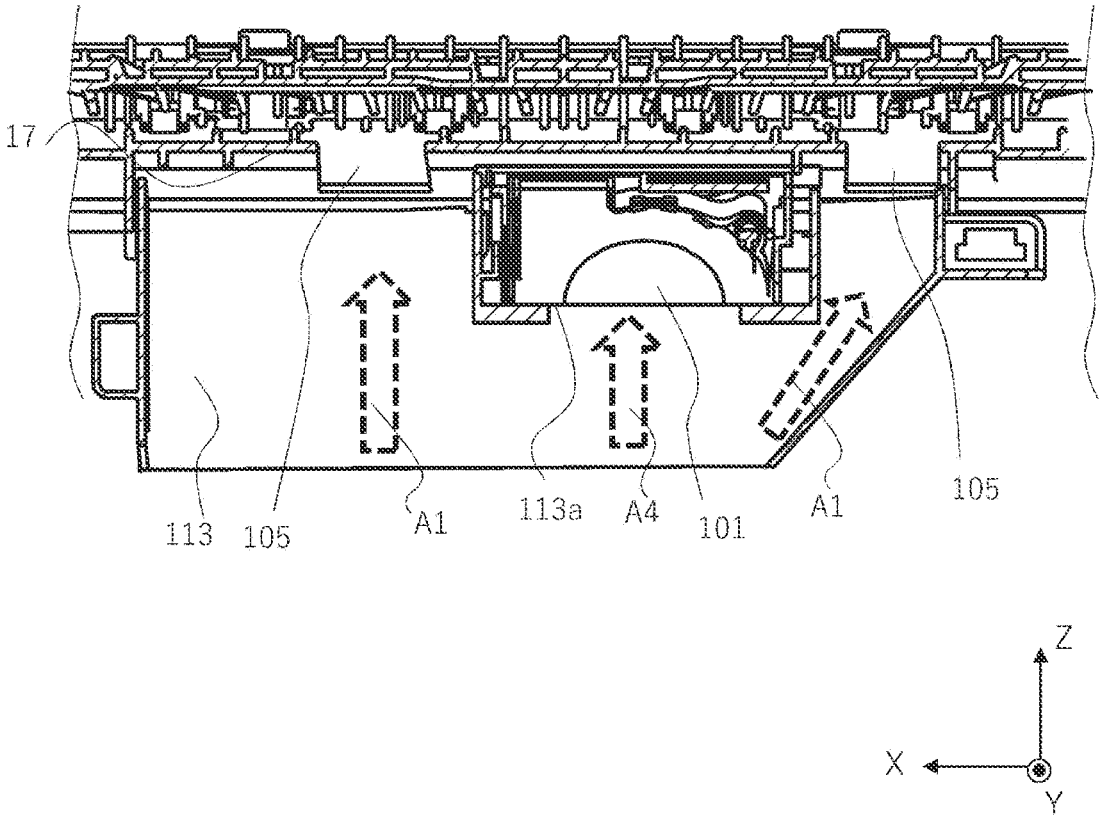
FIG. 9 is a diagram indicating a flow of air by a blowing fan according to Embodiment 2.

FIG. 9 indicates the flow of air in the suction fan lower duct 113. Unlike the case of FIG. 3, the flow of air is generated in the A4 direction because the suction fan lower duct hole 113*a* has been formed, whereby air of the blowing fan 110 can be applied to the case of the suction fan 101.

In the apparatus, the suction fan 101 sucks air in the section between the fixing apparatus 14 and the discharging roller pair 18. Since this section is a region where the recording material S, which was heated in the fixing step, is conveyed, the temperature of the air to be sucked is relatively high, which may increase the temperature of the suction fan 101. In Embodiment 2, however, fresh air sent from the blowing fan 110 can be applied to the suction fan 101, hence a temperature increase in the suction fan 101 can be controlled. As a consequence, the effect of Embodiment 1, that is, an increase in the cooling function in the interior of the image forming apparatus while avoiding an increase in the size of the apparatus, can be further improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-024574, filed Feb. 18, 2021, which is hereby incorporated by reference wherein in its entirety.

What is claimed is:

1. An image forming apparatus, comprising:

an image forming unit configured to form a toner image on one surface of a recording material;

a fixing unit that includes a heating unit and is configured to heat and fix the toner image formed on the one surface of the recording material;

a discharging unit configured to discharge the recording material, on which the toner image is fixed by the fixing unit, to a discharged paper tray; and a guide member that is disposed between the fixing unit and the discharging unit and is configured to form a recording material conveying path for conveying the recording material from the fixing unit to the discharging unit, wherein on the guide member, a blowing port to send air to the recording material conveying path and a suction port to suck air from the recording material conveying path are disposed on a same surface so as not to cross over the recording material being conveyed, and the suction port is positioned at a different position than the blowing port in a direction orthogonal to the conveying direction of the recording material.

2. The image forming apparatus according to claim 1 wherein the blowing port and the suction port are disposed so as to face one surface of the recording material.

3. The image forming apparatus according to claim 1, further comprising:

a blowing fan configured to send air to the blowing port; and a suction fan configured to suck air from the suction port, wherein the recording material is cooled by sending air to the blowing port and applying the air to the recording material using the blowing fan, and the suction fan sucks the air, after cooling the recording material, through the suction port.

4. The image forming apparatus according to claim 3, wherein the suction port is disposed at an approximate center portion of the guide member in a direction orthogonal to the conveying direction of the recording material, and the blowing port is disposed on both sides of the suction port in the direction orthogonal to the conveying direction of the recording material.

5. The image forming apparatus according to claim 3, further comprising:

a reversing unit configured to reverse the recording material after an image is formed on the one surface of the recording material, so that an image is formed on the other surface of the recording material, wherein the recording material being conveyed by the reversing unit is cooled by sending air to the blowing port by the blowing fan and applying the air to the recording material.

6. The image forming apparatus according to claim 3, wherein the air sent from the blowing fan is applied to the suction fan.

7. The image forming apparatus according to claim 3, wherein the suction fan discharges the air, sucked from the suction port, out of the image forming apparatus.

8. The image forming apparatus according to claim 7, wherein the suction fan discharges the air sucked from the suction port in a direction that does not interfere with the direction of the flowing of the air taken in by the blowing fan.

9. The image forming apparatus according to claim 3, wherein the blowing fan takes air in from outside the image forming apparatus and sends the air to the blowing port.

10. The image forming apparatus according to claim 9 further comprising:

a duct that connects an exterior surface of the image forming apparatus to the blowing port, wherein the blowing fan sends the air that is taken in to the blowing port via the duct.

11. The image forming apparatus according to claim 10, wherein a duct hole to guide the air sent from the blowing fan to the suction fan is formed in the duct, and the suction fan is cooled by the air sent via the duct hole being applied to the suction fan.

12. The image forming apparatus according to claim 3, wherein the guiding member is configured such that the air flows from the blowing port to the suction port while the recording material is being conveyed on the recording material conveying path.

13. The image forming apparatus according to claim 12, wherein on the surface of the guide member where the blowing port and the suction port are disposed, a depressed portion which is depressed at least in a section from the blowing port to the suction port with respect to the recording material being conveyed, is formed.

14. The image forming apparatus according to claim 12, wherein a space between the guide member and the recording material while the recording material is being conveyed on the recording material conveying path is wider in the region facing the blowing port and the suction port than in the other regions.

* * * * *